US012800222B2

(12) United States Patent
Song et al.

(10) Patent No.: US 12,800,222 B2
(45) Date of Patent: Nov. 17, 2026

(54) LEAKAGE DETECTION SYSTEM OF RELIQUEFACTION SYSTEM FOR SHIP

(71) Applicant: HANWHA OCEAN CO., LTD., Geoje-si (KR)

(72) Inventors: Jihoon Song, Siheung-si (KR); Won Jae Choi, Siheung-si (KR); Seung Chul Lee, Seoul (KR)

(73) Assignee: HANWHA OCEAN CO., LTD., Geoje-si (KR)

( * ) Notice: Subject to any disclaimer, the term of this patent is extended or adjusted under 35 U.S.C. 154(b) by 213 days.

(21) Appl. No.: 18/702,153

(22) PCT Filed: Dec. 27, 2021

(86) PCT No.: PCT/KR2021/019905
§ 371 (c)(1),
(2) Date: Apr. 17, 2024

(87) PCT Pub. No.: WO2023/075024
PCT Pub. Date: May 4, 2023

(65) Prior Publication Data

US 2025/0237430 A1 Jul. 24, 2025

(30) Foreign Application Priority Data

Oct. 29, 2021 (KR) ..... 10-2021-0147144

(51) Int. Cl.
*F25J 1/02* (2006.01)
*F25J 1/00* (2006.01)

(52) U.S. Cl.
CPC ..... *F25J 1/0256* (2013.01); *F25J 1/0025* (2013.01); *F25J 1/0072* (2013.01); *F25J 1/0204* (2013.01);
(Continued)

(58) Field of Classification Search
CPC .... F25B 11/02; F25B 2500/222; F25B 40/00; F25B 49/005; F25J 1/0025; F25J 1/004;
(Continued)

(56) References Cited

U.S. PATENT DOCUMENTS 5,412,978 A * 5/1995 Boone ..... G01M 3/3254 73/40
8,256,230 B2 * 9/2012 An ..... F25J 1/0025 62/48.2

(Continued)

FOREIGN PATENT DOCUMENTS

CN 107543663 A 1/2018
CN 108779941 A 11/2018

(Continued)

OTHER PUBLICATIONS

International Search Report and Written Opinion for International Application No. PCT/KR2021/019905 dated Jul. 15, 2022, in 4 pages (English translation of ISR only).

(Continued)

*Primary Examiner* — Filip Zec
(74) *Attorney, Agent, or Firm* — Knobbe, Martens, Olson & Bear, LLP

(57) ABSTRACT

A leakage detection system includes: a gas supply line along which boil-off gas is supplied to a compressor; a reliquefaction line along which the compressed boil-off gas is cooled and reliquefied through a heat exchanger and is returned to a storage tank; a refrigerant circulation line along which a refrigerant is circulated; a refrigerant compressor to compress the refrigerant discharged from the heat exchanger; a refrigerant expander expanding and cooling the compressed refrigerant compressed by the refrigerant compressor and having been cooled through the heat exchanger and supplying the cooled refrigerant back to the heat exchanger; and a refrigerant charge line connecting an
(Continued)

inventory tank filled with nitrogen to an upstream side of the refrigerant compressor. Upon initial start-up or restart of a reliquefaction process, the nitrogen is supplied to the upstream side of the refrigerant compressor via the refrigerant charge line to detect leaks in the refrigerant circulation line.

7 Claims, 3 Drawing Sheets

(52) U.S. Cl.
CPC ..... *F25J 1/0247* (2013.01); *F25J 1/0277* (2013.01); *F25J 2210/60* (2013.01); *F25J 2210/90* (2013.01); *F25J 2270/14* (2013.01); *F25J 2290/70* (2013.01); *F25J 2290/90* (2013.01)

(58) Field of Classification Search
CPC ..... F25J 1/005; F25J 1/0072; F25J 1/0204; F25J 1/0208; F25J 1/023; F25J 1/0247; F25J 1/025; F25J 1/0256; F25J 1/0277; F25J 2210/06; F25J 2210/60; F25J 2210/90; F25J 2215/62; F25J 2215/64; F25J 2245/02; F25J 2270/14; F25J 2290/70; F25J 2290/90
See application file for complete search history.

(56) References Cited

U.S. PATENT DOCUMENTS

| | | | | |
|---|---|---|---|---|
| 8,520,195 | B2 * | 8/2013 | Ramos | G01D 5/3537 356/72 |
| 8,596,417 | B2 * | 12/2013 | Barrett | F16N 29/04 184/6.4 |
| 9,846,103 | B2 * | 12/2017 | Strong | G01M 3/2892 |
| 9,863,697 | B2 * | 1/2018 | Roberts | F25J 1/0202 |
| 10,961,880 | B2 * | 3/2021 | Karcher | F01M 1/02 |
| 11,181,436 | B2 * | 11/2021 | Money | G01M 3/3209 |
| 11,325,682 | B2 * | 5/2022 | Lee | F17C 13/002 |
| 11,466,599 | B2 * | 10/2022 | Rigouste | F16K 11/105 |
| 11,549,646 | B2 * | 1/2023 | Bernhardt | F25J 1/0277 |
| 11,698,169 | B2 * | 7/2023 | Hodgson | F17C 13/002 62/48.1 |
| 11,752,837 | B1 * | 9/2023 | Peters | F02C 6/00 60/668 |
| 11,772,810 | B2 * | 10/2023 | Peyron | B64D 27/18 244/57 |
| 11,808,663 | B2 * | 11/2023 | Al-Hashmy | G01M 3/18 |
| 12,006,017 | B2 * | 6/2024 | Shin | F25J 1/0277 |
| 12,228,245 | B2 * | 2/2025 | Mallet | F02C 7/16 |
| 12,281,567 | B1 * | 4/2025 | Sullivan | E21B 47/117 |
| 2016/0216029 | A1 | 7/2016 | Ragot | |
| 2020/0333050 | A1 * | 10/2020 | Prosser | F25J 1/0017 |
| 2021/0148783 | A1 | 5/2021 | Rebich | |
| 2023/0296294 | A1 * | 9/2023 | Pages | F25J 1/0065 62/115 |
| 2024/0060735 | A1 * | 2/2024 | Werner | G01M 3/226 |
| 2024/0288117 | A1 * | 8/2024 | Mallet | F01M 11/10 |

FOREIGN PATENT DOCUMENTS

| | | | |
|---|---|---|---|
| CN | 113503466 | A | 10/2021 |
| EP | 1959217 | A2 | 8/2008 |
| JP | S57-147915 | A | 9/1982 |
| JP | H02-035326 | A | 2/1990 |
| JP | 2541615 | B2 | 10/1996 |
| JP | 2009-204080 | A | 9/2009 |
| JP | 2017-009276 | A | 1/2017 |
| JP | 2019-501060 | A | 1/2019 |
| JP | 2020-523251 | A | 8/2020 |
| JP | 2020-529558 | A | 10/2020 |
| KR | 10-0804953 | B1 | 2/2008 |
| KR | 10-2010-0086299 | A | 7/2010 |
| KR | 10-2016-0144884 | A | 12/2016 |
| KR | 10-1701702 | B1 | 2/2017 |
| KR | 10-2018-0033734 | A | 4/2018 |
| KR | 10-2018-0113019 | A | 10/2018 |
| KR | 10-2033538 | B1 | 10/2019 |
| KR | 10-2020-0065533 | A | 6/2020 |
| KR | 10-2020-0101063 | A | 8/2020 |
| KR | 10-2020-0112050 | A | 10/2020 |
| KR | 10-2021-0023540 | A | 3/2021 |
| KR | 10-2246344 | B1 | 4/2021 |
| KR | 10-2021-0060393 | A | 5/2021 |
| WO | WO 2015/196955 | A1 | 12/2015 |

OTHER PUBLICATIONS

Notice of Allowance of KR Patent Application No. 10-2021-0147144 dated Mar. 14, 2023, in 4 pages.
Extended European Search Report in EP Application No. 21962647.0 dated Oct. 16, 2025.
Office Action received in Japanese patent application No. 2024-521771 dated Apr. 15, 2025.
Office Action received in corresponding CN Application No. 202180103856.X, dated Aug. 6, 2026.

* cited by examiner

LEAKAGE DETECTION SYSTEM OF RELIQUEFACTION SYSTEM FOR SHIP

TECHNICAL FIELD

The present invention relates to a leakage detection system of a reliquefaction system for ships and, more particularly, to a leakage detection system that can detect leaks in a heat exchanger upon initial start-up or restart of a reliquefaction system reliquefying boil-off gas generated in a ship.

BACKGROUND ART

Natural gas contains methane as a main component and has been attracting attention as an eco-friendly fuel that emits little or no environmental pollutants during combustion. Liquefied natural gas (LNG) is obtained by liquefying natural gas through cooling to about −163° C. under normal pressure and is suited to long-distance transportation by sea since it has a volume of about 1/600 that of natural gas in a gaseous state. Accordingly, natural gas is stored and transported as liquefied natural gas, which is easy to store and transport.

Since natural gas is liquefied at a cryogenic temperature of −163° C. under normal pressure, LNG storage tanks are typically insulated to maintain LNG in a liquid state. However, despite being insulated, such a storage tank is limited in ability to block external heat. Accordingly, due to external heat continuously transferred to the LNG storage tank, LNG stored in the LNG tank continues to evaporate naturally during transportation, causing generation of boil-off gas (BOG).

Continuous production of boil-off gas in the LNG storage tank increases the internal pressure of the LNG storage tank. If the internal pressure of the storage tank exceeds a predetermined safe pressure, this can cause an emergency situation such as rupture of the storage tank. Accordingly, there is a need to discharge boil-off gas from the storage tank using a safety valve. However, boil-off gas is a kind of LNG loss and is an important issue for transportation efficiency and fuel efficiency of LNG. Therefore, various methods are employed to handle boil-off gas generated in the LNG storage tank.

Recently, a method of using boil-off gas at a fuel demand site such as an engine of a ship, a method of reliquefying boil-off gas and returning the reliquefied boil-off gas to an LNG storage tank, and a method combining these two approaches have been developed and put into use.

DISCLOSURE

Technical Tasks

In a reliquefaction cycle for reliquefaction of boil-off gas generated in a ship, typical available liquefaction methods include a process using a single mixed refrigerant (SMR) cycle and a process using a propane-precooled mixed refrigerant (C3MR) cycle. The C3MR cycle is a process in which natural gas is cooled using propane refrigerant alone and then is liquefied and subcooled using a mixed refrigerant, while the SMR cycle is a process in which natural gas is liquefied using a mixed refrigerant composed of multiple components.

As such, the SMR cycle and the C3MR cycle both use a mixed refrigerant. However, if the composition of the mixed refrigerant changes due to refrigerant loss during liquefaction of boil-off gas, this can lead to poor liquefaction efficiency. Accordingly, there is a need to maintain constant composition of the refrigerant by continuously measuring the composition of the mixed refrigerant and replenishing lacking refrigerant components.

An alternative reliquefaction cycle to reliquefy boil-off gas is a single-cycle liquefaction process using nitrogen refrigerant.

Despite relative inefficiency compared to a reliquefaction cycle using a mixed refrigerant, such a reliquefaction cycle using nitrogen refrigerant is safer due to inert properties of nitrogen refrigerant and is easier to apply to ships since nitrogen refrigerant undergoes no phase change.

A reliquefaction system includes: a compressor receiving and compressing boil-off gas; a heat exchanger cooling the compressed gas from the compressor through heat exchange with refrigerant; and a refrigerant circulation unit through which the refrigerant exchanging heat with the compressed gas in the heat exchanger is circulated. When the reliquefaction system employs a refrigeration cycle using nitrogen refrigerant, the refrigerant circulation unit may be configured such that the refrigerant discharged from the heat exchanger after exchanging heat with the compressed gas is compressed, cooled through the heat exchanger, expanded and cooled again, and circulated to the heat exchanger.

As such, the reliquefaction system, especially, the heat exchanger, is supplied with extremely cold LNG boil-off gas and nitrogen refrigerant, which is colder than the boil-off gas. Any leakage of such extremely cold, flammable substances due to damage to the heat exchanger or the like can pose a significant risk to safety of crew and the ship.

During operation of the reliquefaction system, warning signals from pressure sensors disposed upstream/downstream of each pipeline connected to the heat exchanger provide immediate indication of the presence of leakage. However, upon initial start-up or restart of the reliquefaction system, leakage detection can be delayed since leakage detection by the pressure sensors is not possible and there is no device or instruction to check for leakage separately.

To solve this problem, the present invention proposes a solution to promptly detect leaks in a heat exchanger upon initial start-up or restart of a reliquefaction system, thereby ensuring safety of a ship.

Technical Solutions

In accordance with one aspect of the present invention, there is provided a leakage detection system of a reliquefaction system for ships, including: a gas supply line along which boil-off gas generated from a liquefied gas stored in a storage tank of a ship is supplied to a compressor;

- a reliquefaction line along which the boil-off gas compressed by the compressor is cooled and reliquefied through a heat exchanger and is returned to the storage tank;
- a refrigerant circulation line along which a refrigerant exchanging heat with the compressed boil-off gas in the heat exchanger is circulated;
- a refrigerant compressor disposed on the refrigerant circulation line to compress the refrigerant discharged from the heat exchanger after cooling the compressed boil-off gas;
- a refrigerant expander expanding and cooling the refrigerant compressed by the refrigerant compressor and having been cooled through the heat exchanger and supplying the cooled refrigerant back to the heat exchanger; and a refrigerant charge line connecting an inventory tank filled with nitrogen to an upstream side of the refrigerant compressor on the refrigerant circulation line, wherein, upon initial start-up or restart of a reliquefaction process, the nitrogen is supplied to the upstream side of the refrigerant compressor via the refrigerant charge line to detect leaks in the refrigerant circulation line.

Preferably, the leakage detection system further includes: a first valve disposed on the refrigerant circulation line upstream of a junction between the refrigerant circulation line and the refrigerant charge line; a second valve disposed on the refrigerant circulation line between the refrigerant expander and the heat exchanger; and a third valve disposed on the refrigerant charge line.

Preferably, after a section of the refrigerant circulation line ranging from a high pressure portion downstream of the refrigerant compressor to a low pressure portion downstream of the refrigerant expander is checked for leaks by closing the first and second valves and opening the third valve to allow the nitrogen to pass through the section of the refrigerant circulation, the first and second valves are opened to charge the refrigerant circulation line with nitrogen refrigerant and to check for leaks in a section of the refrigerant circulation line ranging from the low pressure portion downstream of the refrigerant expander to a low pressure portion upstream of the refrigerant compressor.

Preferably, the gas supply line is connected to the compressor through the heat exchanger; the leakage detection system further includes: a fourth valve disposed on the gas supply line upstream of the heat exchanger; and a fifth valve disposed on the gas supply line upstream of the compressor; and, upon initial start-up or restart of the reliquefaction process, a low pressure portion of the heat exchanger through which the boil-off gas passes along the gas supply line is checked for leaks by closing the fourth and fifth valves, independently of leak detection in the refrigerant circulation line.

Preferably, the leakage detection system further includes: a preheating line branched off of the gas supply line upstream of the fourth valve and connected to the gas supply line upstream of the heat exchanger; a preheater disposed on the preheating line to heat the boil-off gas; a sixth valve disposed on the preheating line downstream of the preheater; and a seventh valve disposed on a pipeline branched off of the preheating line downstream of the preheater and connected to an upstream side of the compressor without passing through the heat exchanger.

Preferably, the leakage detection system further includes: a gas-liquid separator disposed on the reliquefaction line downstream of the heat exchanger to separate the reliquefied gas into a gaseous phase and a liquid phase; a bypass line branched off of the reliquefaction line downstream of the heat exchanger and connected to the storage tank without passing through the gas-liquid separator; an eighth valve disposed on the reliquefaction line upstream of the heat exchanger; a ninth valve disposed on the reliquefaction line upstream of the gas-liquid separator; and a tenth valve disposed on the bypass line, wherein, upon initial start-up or restart of the reliquefaction process, a high pressure portion of the heat exchanger through which the boil-off gas passes along the reliquefaction line is checked for leaks by closing the eighth to tenth valves, independently of leak detection in the refrigerant circulation line.

Preferably, the leakage detection system further includes: a pressure compensation line branched off of the reliquefaction line downstream of the compressor and connected to an upstream side of the gas-liquid separator; a nitrogen blanket line along which the nitrogen is supplied to the pressure compensation line; an eleventh valve disposed on the pressure compensation line upstream of a junction between the pressure compensation line and the nitrogen blanket line; a twelfth valve disposed on the nitrogen blanket line; and a thirteenth valve disposed on the pressure compensation line downstream of the junction between the pressure compensation line and the nitrogen blanket line, wherein the boil-off gas or the nitrogen is supplied to the gas-liquid separator via the pressure compensation line to adjust an internal pressure of the gas-liquid separator.

Preferably, the high pressure portion of the heat exchanger through which the boil-off gas in the reliquefaction line passes is checked for leaks by closing the eighth to tenth valves and the thirteenth valve while opening the eleventh and twelfth valves to allow supply of the nitrogen from the nitrogen blanket line.

Advantageous Effects

The leakage detection system according to the present invention can provide prompt detection of leaks in a heat exchanger and each pipeline connected to the heat exchanger during a refrigerant charging process upon initial start-up or restart of a reliquefaction system.

The leakage detection system according to the present invention can provide cost reduction by eliminating the need to install separate equipment to detect leaks and allows the heat exchanger to be checked for leaks during the refrigerant charging process through operation of respective valves on pipelines connected to the heat exchanger, thereby reducing the preparation time for starting the reliquefaction system while ensuring safety of a ship.

EMBODIMENTS

Figure 1:
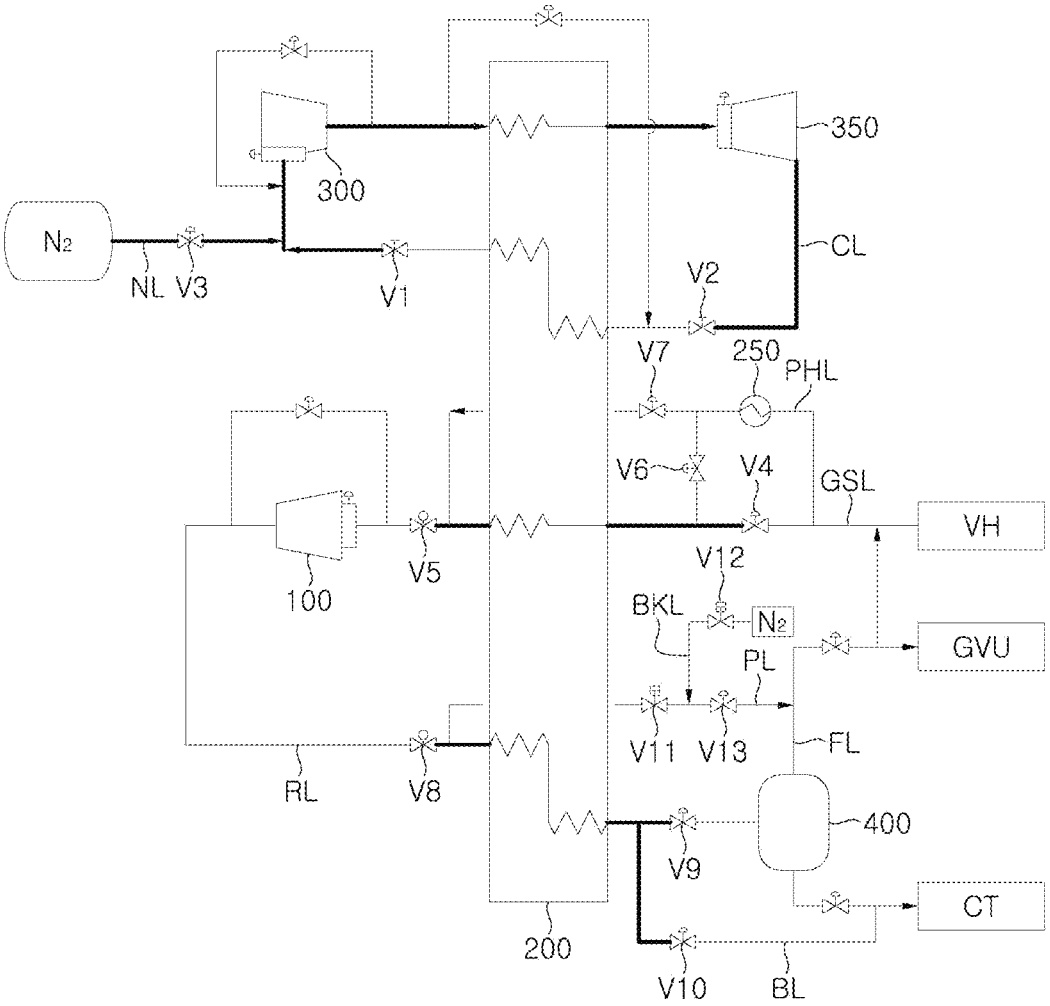
FIG. 1 to FIG. 3 are schematic diagrams illustrating a process of detecting leaks in a heat exchanger and each pipeline connected to the heat exchanger by a leakage detection system of a reliquefaction system for ships according to one embodiment of the present invention.

In order to fully appreciate the operational advantages of the present invention and the objectives achieved by practicing the present invention, reference should be made to the accompanying drawings, which illustrate preferred embodiments of the present invention, and description thereof.

Hereinafter, exemplary embodiments of the present invention will be described in detail in terms of the features and effects thereof with reference to the accompanying drawings. It should be noted that like components will be denoted by like reference numerals throughout the specification and the accompanying drawings.

As used herein, the term "ship" may refer to any type of ship that is provided with a liquefied gas storage tank. For example, the ship may include self-propelled vessels, such as an LNG carrier, a liquid hydrogen carrier, and an LNG regasification vessel (RV), as well as non-self-propelled floating offshore structures, such as an LNG floating production storage and offloading (FPSO) unit and an LNG floating storage regasification unit (FSRU).

In addition, the embodiments of the present invention may be applied to a reliquefaction cycle for any type of liquefied gas that can be transported in a liquid state by liquefaction at cryogenic temperatures and can generate boil-off gas during storage. For example, such liquefied gas may include liquefied petrochemical gas, such as liquefied natural gas (LNG), liquefied ethane gas (LEG), liquefied petroleum gas (LPG), liquefied ethylene gas, and liquefied propylene gas. In the following embodiments, the present invention will be described using LNG, which is a typical liquefied gas, as an example.

Figure 2:
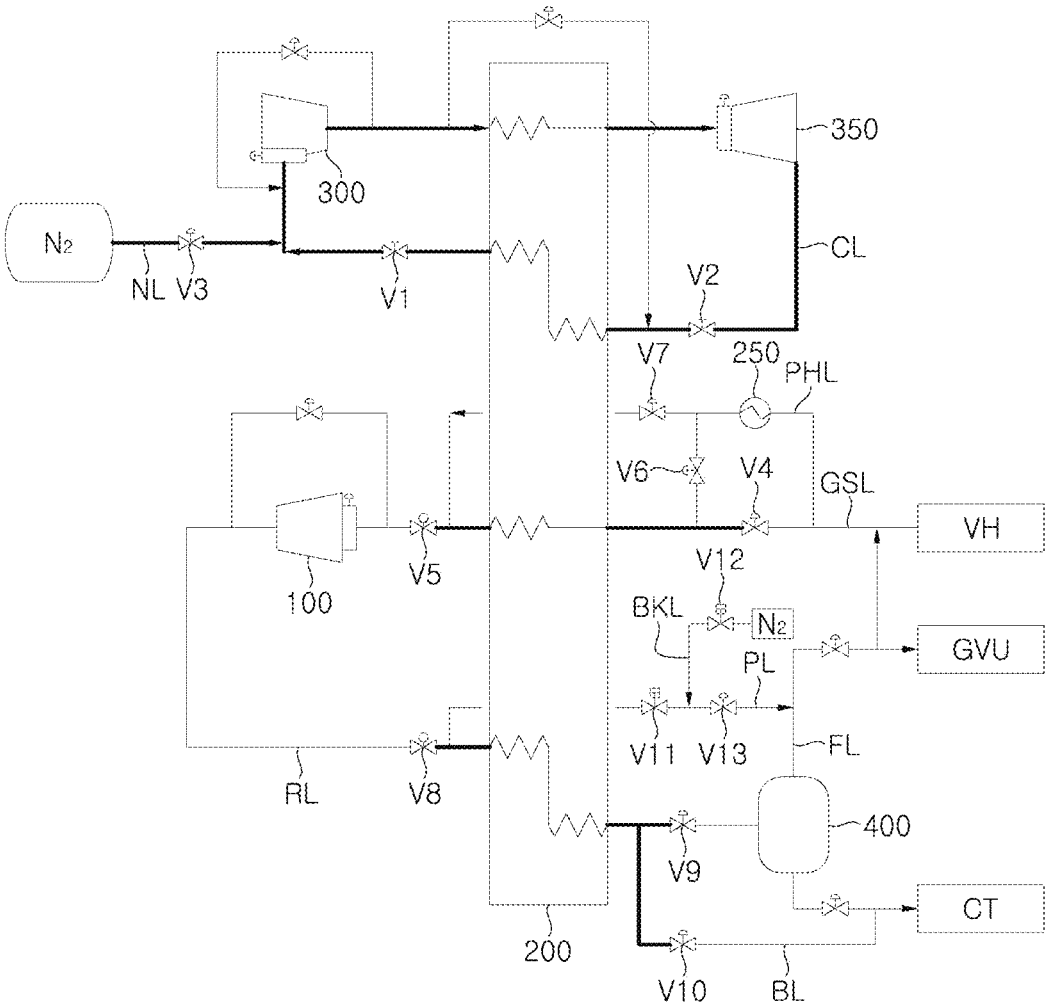
Figure 3:
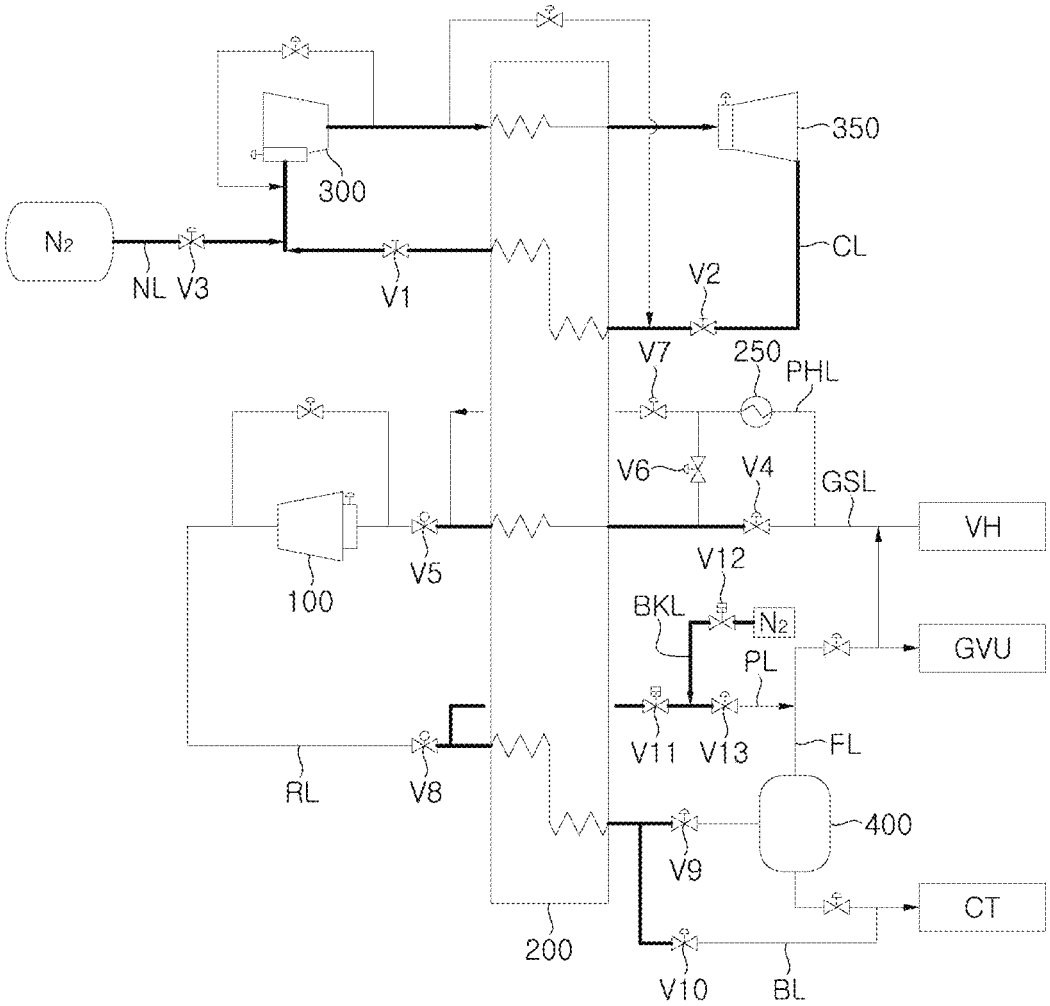

FIG. 1 to FIG. 3 are schematic diagrams illustrating a process of detecting leaks in a heat exchanger and each pipeline connected to the heat exchanger by a leakage detection system of a reliquefaction system for ships according to one embodiment of the present invention.

The reliquefaction system for ships according to this embodiment is a system in which boil-off gas generated from a liquefied gas stored in a storage tank of a ship is discharged through a vapor header, is delivered to a compressor for compression, and is supplied as fuel to an engine of the ship or the like, as needed, and surplus boil-off gas is cooled and reliquefied through heat exchange in a heat exchanger and is returned to the storage tank.

Referring to FIG. 1 to FIG. 3, the system according to this embodiment includes: a gas supply line GSL along which boil-off gas is supplied from a vapor header VH to a compressor 100; a reliquefaction line RL along which the compressed gas from the compressor 100 is cooled and reliquefied through a heat exchanger 200 and is returned to the storage tank; and a refrigerant circulation line CL along which a refrigerant exchanging heat with the compressed gas in the heat exchanger 200 is circulated.

The refrigerant circulation line CL is provided with: a refrigerant compressor 300 compressing the refrigerant discharged from the heat exchanger after cooling the compressed boil-off gas; and a refrigerant expander 350 expanding and cooling the refrigerant compressed by the refrigerant compressor and having been cooled through the heat exchanger and supplying the cooled refrigerant to the heat exchanger, wherein the system according to this embodiment further includes a refrigerant charge line NL connecting an onboard inventory tank filled with nitrogen to an upstream side of the refrigerant compressor on the refrigerant circulation line.

The gas supply line GSL is connected from the storage tank to the compressor 100 through the heat exchanger 200, such that uncompressed boil-off gas from the storage tank is supplied to the compressor to be compressed after supplying cold heat to the heat exchanger.

The compressor 100 may compress the boil-off gas to, for example, a fuel supply pressure required for a main engine of the ship. For example, the compressor may compress the boil-off gas to a pressure of about 5.5 barg for a DF engine, about 15 barg for an X-DF engine, and about 300 barg for an ME-GI engine. The compressed boil-off gas may be supplied as fuel to an engine (not shown) of the ship, and surplus compressed boil-off gas may be reliquefied.

Classification societies require that a compressor supplying fuel to an engine be designed with redundancy in case of emergency. Accordingly, although one compressor is shown in FIG. 1, the compressor may include a main compressor and a redundant compressor. In addition, the compressor may be a multistage compressor including multiple compressors and an intermediate cooler.

The compressed boil-off gas from the compressor 100 is introduced into the heat exchanger 200 along the reliquefaction line RL to be cooled through heat exchange.

The reliquefaction line RL is provided with: the heat exchanger 200 cooling the compressed boil-off gas from the compressor; and a gas-liquid separator 400 separating the cooled boil-off gas from the heat exchanger into a gaseous phase and a liquid phase and supplying separated liquefied gas to the storage tank.

In the heat exchanger 200, the boil-off gas is cooled through heat exchange with the refrigerant circulated along the refrigerant circulation line CL. The refrigerant circulation line is provided with: the refrigerant expander 350 expanding and cooling the refrigerant to be supplied to the heat exchanger; and the refrigerant compressor 300 compressing the refrigerant discharged from the heat exchange after cooling the boil-off gas. The refrigerant compressor and the refrigerant expander may be connected to each other via a common shaft to form a compander that uses energy from expansion of refrigerant to compress the refrigerant, thereby reducing power required to drive a refrigerant cycle.

The refrigerant supplied to the heat exchanger while circulating along the refrigerant circulation line CL may be, for example, nitrogen ($N_2$).

The refrigerant compressed by the refrigerant compressor 300 is cooled by the heat exchanger, expanded and cooled by the refrigerant expander 350, and supplied back to the heat exchanger 200 while circulating along the refrigerant circulation line CL. Accordingly, in the heat exchanger 200, four different streams, that is, the compressed boil-off gas from the compressor, the uncompressed boil-off gas to be introduced into the compressor, the expanded and cooled refrigerant from the refrigerant expander, and the compressed refrigerant from the refrigerant compressor, participate in heat exchange.

The system according to this embodiment further includes a preheating line PHL connected to the gas supply line GSL upstream of the heat exchanger 200 to adjust the temperature of boil-off gas to be introduced into the heat exchanger so as to minimize thermal stress on the heat exchanger.

Specifically, the preheating line PHL is branched off of the gas supply line GSL upstream of the heat exchanger 200 to heat all or some of the boil-off gas and supply the heated boil-off gas to an upstream side of the heat exchanger on the gas supply line GSL. The preheating line PHL is provided with a preheater 250. A heat source for the preheater may include, for example, glycol water, steam, seawater, or fresh water.

The boil-off gas having passed through the preheating line PHL is joined with boil-off gas having passed through the gas supply line GSL without entering the preheating line and is introduced into the heat exchanger 200. The boil-off gas having passed through the heat exchanger is compressed by the compressor 100 and is introduced back into the heat exchanger 200 to be cooled through heat exchange with the nitrogen refrigerant in the refrigerant circulation line CL and the uncompressed boil-off gas in the gas supply line GSL.

The cooled boil-off gas from the heat exchanger is subjected to gas-liquid separation in the gas-liquid separator 400, and separated reliquefied gas is delivered to the storage tank CT. The system according to this embodiment may further include a bypass line BL branched off of the reliquefaction line downstream of the heat exchanger and connected to the storage tank without passing through the gas-liquid separator such that the cooled reliquefied gas from the heat exchanger can be delivered directly to the storage tank.

Opening a valve downstream of the gas-liquid separator to deliver the separated reliquefied gas from the gas-liquid separator to the storage tank can cause changes in pressure in the gas-liquid separator. Here, the pressure in the gas-liquid separator can be maintained at a constant level by flash gas generated from liquefied gas introduced into the separator, that is, off-gas.

However, if the liquefied gas to be introduced into the gas-liquid separator is cooled to a subcooled state through heat exchange with the nitrogen refrigerant in the heat exchanger, this can result in little or no off-gas being generated from the liquefied gas and thus opening of the valve downstream of the gas-liquid separator can cause a sudden drop in pressure in the gas-liquid separator. In order to compensate for such pressure variations in the gas-liquid separator to maintain a constant pressure in the gas-liquid separator, the system according to this embodiment further includes: a pressure compensation line PL branched off of the reliquefaction line RL downstream of the compressor 100 and connected to an upstream side of the gas-liquid separator 400; and a nitrogen blanket line BKL along which nitrogen is supplied to the pressure compensation line. In this way, the pressure in the gas-liquid separator can be maintained at a constant level by supplying boil-off gas or nitrogen to the gas-liquid separator via the pressure compensation line PL upon delivery of reliquefied gas from the separator to the storage tank.

In the system according to this embodiment, initial start-up or restart of the reliquefaction process is required to be preceded by charging nitrogen refrigerant into the refrigerant circulation line of the reliquefaction system.

During the nitrogen refrigerant charging process, nitrogen is supplied to an upstream side of the refrigerant compressor 300 via the refrigerant charge line NL. The system according to this embodiment can simultaneously detect leaks in the heat exchanger and each pipeline connected to the heat exchanger during the refrigerant charging process, thereby reducing the preparation time for starting the reliquefaction process while ensuring safety of the ship.

The reliquefaction system is equipped with valves for opening/closing respective pipelines. Through opening/closing of the valves, the heat exchanger and each pipeline connected to the heat exchanger can be simultaneously checked for leaks during the refrigerant charging process.

Regarding the valves, a first valve V1 is disposed on the refrigerant circulation line CL upstream of a junction between the refrigerant circulation line CL and the refrigerant charge line NL, a second valve V2 is disposed on the refrigerant circulation line CL between the refrigerant expander 350 and the heat exchanger 200, and a third valve V3 is disposed on the refrigerant charge line NL, as shown in FIG. 1 to FIG. 3.

A fourth valve V4 is disposed on the gas supply line GSL upstream of the heat exchanger 200, and a fifth valve V5 is disposed on the gas supply line GSL downstream of the heat exchanger 200 and upstream of the compressor 100, wherein the preheating line PHL is branched off of the gas supply line upstream of the fourth valve. A sixth valve V6 is disposed on the preheating line downstream of the preheater 250, and a seventh valve V7 is disposed on a pipeline branched off of the preheating line downstream of the preheater and connected to an upstream side of the compressor without passing through the heat exchanger.

An eighth valve V8 is disposed on the reliquefaction line RL upstream of the heat exchanger 200, a ninth valve V9 is disposed on the reliquefaction line RL upstream of the gas-liquid separator 400, and a tenth valve V10 is disposed on the bypass line BL branched off of the reliquefaction line RL upstream of the ninth valve.

An eleventh valve V11 is disposed on the pressure compensation line PL upstream of a junction between the pressure compensation line PL and the nitrogen blanket line BKL, a twelfth valve V12 is disposed on the nitrogen blanket line BKL, and a thirteenth valve V13 is disposed on the pressure compensation line PL downstream of the junction between the pressure compensation line PL and the nitrogen blanket line BKL.

A process of detecting leaks in the heat exchanger and each pipeline connected to the heat exchanger upon initial start-up or restart of the reliquefaction process will be described with reference to FIG. 1 to FIG. 3.

First, the refrigerant circulation line CL is charged with nitrogen refrigerant from the inventory tank storing nitrogen prior to initial start-up or restart of the reliquefaction process, as shown in FIG. 1.

Here, first, a section of the refrigerant circulation line CL ranging from a high pressure portion downstream of the refrigerant compressor 300 to a low pressure portion downstream of the refrigerant expander 350 is checked for leaks by closing the first and second valves V1, V2 and opening the third valve V3 to supply nitrogen from the inventory tank to an upstream side of the refrigerant compressor 300 via the refrigerant charge line NL while allowing the nitrogen to pass through the section of the refrigerant circulation line.

Here, independently of leak detection in the refrigerant circulation line, a low pressure portion of the heat exchanger along the gas supply line GSL may be checked for leaks by closing the fourth and fifth valves V4, V5 and a high pressure portion of the heat exchanger along the reliquefaction line may be checked for leaks by closing the eighth to tenth valves V8, V9, V10. Here, the sixth and seventh valves V6, V7 and the eleventh to thirteenth valves V11, V12, V13 are also closed.

Upon completion of leak detection in a section of the refrigerant circulation line as shown in FIG. 1, which ranges from the first valve V1 to the second valve V2, passing through the high pressure portion downstream of the refrigerant compressor 300 and the low pressure portion downstream of the refrigerant expander 350, the rest of the refrigerant circulation line is checked for leaks by opening the first and second valves V1, V2, as shown in FIG. 2.

That is, the first and second valves V1, V2 are opened to charge the refrigerant circulation line CL with the nitrogen refrigerant and to check for leaks in a section of the refrigerant circulation line CL ranging from the low pressure portion downstream of the refrigerant expander 350 to a low pressure portion upstream of the refrigerant compressor 300, including a low temperature portion of the heat exchanger 200 through which the refrigerant circulation line CL passes.

Here, independently of leak detection in the refrigerant circulation line, both a low pressure portion of the heat exchanger, through which boil-off gas passes along the gas supply line, and a high pressure section of the heat exchanger, through which boil-off gas passes along the reliquefaction line, may be checked for leaks by closing the fourth and fifth valves and the eighth to tenth valves, respectively.

Upon completion of leak detection in the refrigerant circulation line, a portion of the heat exchanger through which boil-off gas passes may be checked for leaks while continuing to charge the refrigerant circulation line CL with the refrigerant and charging the gas-liquid separator 400 with nitrogen for pressure compensation via the nitrogen blanket line BKL.

As shown in FIG. 3, the high pressure portion of the heat exchanger, through which compressed gas to be reliquefied along the reliquefaction line RL passes, may be checked for leaks by closing the eighth to tenth valves V8 to V10 and the thirteenth valve V13 and opening the eleventh and twelfth valves V11, V12 to supply nitrogen via the nitrogen blanket line BKL and to deliver the nitrogen to an upstream side of the heat exchanger 200 on the reliquefaction line RL.

Upon completion of leak detection in the high pressure portion of the heat exchanger, the nitrogen is delivered to the gas-liquid separator to be used for pressure compensation.

As described above, the leakage detection system according to the present invention can detect leaks in the heat exchanger and each pipeline connected to the heat exchanger at the same time during the refrigerant charging process preceding initial start-up or restart of the reliquefaction process through operation of respective valves installed on the pipelines, thereby reducing the preparation time for starting the reliquefaction process while ensuring safety of the ship.

Although some embodiments have been described herein, it will be apparent to a person having ordinary knowledge in the art that the present invention is not limited thereto and may be implemented through various modifications or variations without departing from the technical spirit of the present invention.

The invention claimed is:

1. A leakage detection system of a reliquefaction system for ships, comprising:

a gas supply line along which boil-off gas generated from a liquefied gas stored in a storage tank of a ship is supplied to a compressor;

a reliquefaction line along which the boil-off gas compressed by the compressor is cooled and reliquefied through a heat exchanger and is returned to the storage tank;

a refrigerant circulation line along which a refrigerant exchanging heat with the compressed boil-off gas in the heat exchanger is circulated;

a refrigerant compressor disposed on the refrigerant circulation line to compress the refrigerant discharged from the heat exchanger after cooling the compressed boil-off gas;

a refrigerant expander configured to expand and cool the refrigerant compressed by the refrigerant compressor and having been cooled through the heat exchanger and supply the cooled refrigerant back to the heat exchanger;

a refrigerant charge line connecting an inventory tank filled with nitrogen to an upstream side of the refrigerant compressor on the refrigerant circulation line;

a first valve disposed on the refrigerant circulation line upstream of a junction between the refrigerant circulation line and the refrigerant charge line;

a second valve disposed on the refrigerant circulation line between the refrigerant expander and the heat exchanger; and a third valve disposed on the refrigerant charge line, wherein, upon initial start-up or restart of a reliquefaction process, the nitrogen is supplied to the upstream side of the refrigerant compressor via the refrigerant charge line to detect leaks in the refrigerant circulation line.

2. The leakage detection system according to claim 1, wherein, after a section of the refrigerant circulation line ranging from a high pressure portion downstream of the refrigerant compressor to a low pressure portion downstream of the refrigerant expander is checked for leaks by closing the first and second valves and opening the third valve to allow the nitrogen to pass through the section of the refrigerant circulation line, the first and second valves are opened to charge the refrigerant circulation line with nitrogen refrigerant and to check for leaks in a section of the refrigerant circulation line ranging from the low pressure portion downstream of the refrigerant expander to a low pressure portion upstream of the refrigerant compressor.

3. The leakage detection system according to claim 1, wherein:

the gas supply line is connected to the compressor through the heat exchanger;

the leakage detection system further comprises:

a fourth valve disposed on the gas supply line upstream of the heat exchanger; and a fifth valve disposed on the gas supply line upstream of the compressor; and, upon initial start-up or restart of the reliquefaction process, a low pressure portion of the heat exchanger through which the boil-off gas passes along the gas supply line is checked for leaks by closing the fourth and fifth valves, independently of leak detection in the refrigerant circulation line.

4. The leakage detection system according to claim 3, further comprising:

a preheating line branched off of the gas supply line upstream of the fourth valve and connected to the gas supply line upstream of the heat exchanger;

a preheater disposed on the preheating line to heat the boil-off gas;

a sixth valve disposed on the preheating line downstream of the preheater; and a seventh valve disposed on a pipeline branched off of the preheating line downstream of the preheater and connected to an upstream side of the compressor without passing through the heat exchanger.

5. The leakage detection system according to claim 3, further comprising:

a gas-liquid separator disposed on the reliquefaction line downstream of the heat exchanger to separate the reliquefied gas into a gaseous phase and a liquid phase;

a bypass line branched off of the reliquefaction line downstream of the heat exchanger and connected to the storage tank without passing through the gas-liquid separator;

an eighth valve disposed on the reliquefaction line upstream of the heat exchanger;

a ninth valve disposed on the reliquefaction line upstream of the gas-liquid separator; and a tenth valve disposed on the bypass line, wherein, upon initial start-up or restart of the reliquefaction process, a high pressure portion of the heat exchanger through which the boil-off gas passes along the reliquefaction line is checked for leaks by closing the eighth to tenth valves, independently of leak detection in the refrigerant circulation line.

6. The leakage detection system according to claim 5, further comprising:

a pressure compensation line branched off of the reliquefaction line downstream of the compressor and connected to an upstream side of the gas-liquid separator;

a nitrogen blanket line along which the nitrogen is supplied to the pressure compensation line;

an eleventh valve disposed on the pressure compensation line upstream of a junction between the pressure compensation line and the nitrogen blanket line;

a twelfth valve disposed on the nitrogen blanket line; and a thirteenth valve disposed on the pressure compensation line downstream of the junction between the pressure compensation line and the nitrogen blanket line, wherein the boil-off gas or the nitrogen is supplied to the gas-liquid separator via the pressure compensation line to adjust an internal pressure of the gas-liquid separator.

7. The leakage detection system according to claim 6, wherein the high pressure portion of the heat exchanger through which the boil-off gas in the reliquefaction line passes is checked for leaks by closing the eighth to tenth valves and the thirteenth valve while opening the eleventh and twelfth valves to allow supply of the nitrogen from the nitrogen blanket line.

* * * * *